US008212850B2

(12) United States Patent
Abe et al.

(10) Patent No.: US 8,212,850 B2
(45) Date of Patent: Jul. 3, 2012

(54) RECORDING APPARATUS FOR PRINTING IMAGES ON THE ENTIRE SURFACE OF A RECORDING SHEET

(75) Inventors: Yoshibumi Abe, Fukushima-ken (JP); Minoru Sato, Fukushima-ken (JP); Zenko Motoki, Fukushima-ken (JP); Eihin Setsu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 610 days.

(21) Appl. No.: 12/360,179

(22) Filed: Jan. 27, 2009

(65) Prior Publication Data

US 2009/0189342 A1 Jul. 30, 2009

(30) Foreign Application Priority Data

Jan. 28, 2008 (JP) ..... 2008-016093

(51) Int. Cl.
*B41J 17/00* (2006.01)

(52) U.S. Cl. ..... 347/215; 347/197

(58) Field of Classification Search ..... 347/197, 347/198, 215, 217, 218, 220, 221, 222; 271/274
See application file for complete search history.

(56) References Cited

U.S. PATENT DOCUMENTS 3,935,938 A * 2/1976 Hodne ..... 400/317.1
5,775,823 A * 7/1998 Bekki et al. ..... 400/629
7,439,994 B2 * 10/2008 Abe et al. ..... 347/215
2007/0035085 A1 2/2007 Abe et al.
2008/0100687 A1 * 5/2008 Abe et al. ..... 347/215

FOREIGN PATENT DOCUMENTS

JP 2007-45577 2/2007

* cited by examiner

*Primary Examiner* — Julian Huffman
*Assistant Examiner* — Sharon A Polk
(74) *Attorney, Agent, or Firm* — Hunton & Williams LLP

(57) ABSTRACT

A recording apparatus including a printing unit that contacts or separates a thermal head with or from a platen using the driving force of a UD motor, one or more sheet feed units that include sheet feed rollers which are rotated forward or backward by the driving force of an LF motor transmitted through a transport gear group and pressure rollers which are supported between a pair of roller supporting members and are urged by elastic members to come into pressure contact with the sheet feed rollers, and are provided on an upstream side and a downstream side of the printing unit in a transport path of a recording sheet, a pressure release mechanism including a cam shaft that is rotatably provided so as to tilt the pair of roller supporting members of the sheet feed units against the urging force of the elastic members and separates the pressure rollers from the sheet feed rollers, and a pressure release gear group that transmits the driving force of the LF motor to the cam shaft of the pressure release mechanism, the driving force of the LF motor being transmitted to the pressure release gear group and the transport gear group.

1 Claim, 14 Drawing Sheets

RECORDING APPARATUS FOR PRINTING IMAGES ON THE ENTIRE SURFACE OF A RECORDING SHEET

CLAIM OF PRIORITY

This application claims benefit of the Japanese Patent Application No. 2008-16093 filed on Jan. 28, 2008, the entire content of which is hereby incorporated by reference.

BACKGROUND OF THE DISCLOSURE

1. Technical Field

The present invention relates to a recording apparatus capable of printing images on the entire surface of a recording sheet without a blank, and more particularly, to a recording apparatus capable of simplifying the structure of a sheet feed mechanism and reducing manufacturing costs.

2. Related Art

JP-A-2007-45577 discloses a recording apparatus capable of printing images on the entire surface of a recording sheet without a blank. The recording apparatus includes a first sheet feed unit that is provided on the upstream side in a direction in which the recording sheet is transported during printing and a second sheet feed unit that is provided on the downstream side in the transport direction. Each of the sheet feed units includes a sheet feed roller that can be rotated by the driving force of an LF motor, which is a driving source, and a pressure roller that can come into pressure contact with the sheet feed roller by the driving force of a CR motor, which also is a driving source. The recording sheet is pinched between the sheet feed roller and the pressure roller of each of the sheet feed units and is then transported by the rotation of the sheet feed rollers.

Each of the sheet feed units is provided with a pair of roller supporting members that rotatably support a rotating shaft of the pressure roller. A roller supporting portion that can rotatably support the rotating shaft of the pressure roller is formed at one end of each of the roller supporting members, and the other end of each of the roller supporting members is elastically urged by an elastic member.

In addition, a printing unit that prints a desired image on the recording sheet is provided between the first sheet feed unit and the second sheet feed unit. The printing unit includes a platen roller that is rotatably provided on the transport path of the recording sheet and a thermal head that can come into pressure contact with the platen roller by the driving force of a UD motor, which is a driving source.

A pressure release mechanism that can separate the pressure roller from the sheet feed roller is connected to the pressure roller of the first sheet feed unit. The pressure release mechanism includes a connection gear and a driving gear that is rotatably supported substantially at the center of the cam shaft and is engaged with the connection gear. When a connection shaft is rotated by the CR motor, which is a driving source, the cam shaft is rotated at a predetermined angle through the connection gear and the driving gear, and the roller supporting member is rotated about a rotation supporting portion provided in a printer body against the urging force of the elastic member. Then, the pressure roller is separated from the sheet feed roller by a predetermined distance.

As described above, in the sheet feed mechanism of the recording apparatus capable of printing images on the entire surface of a recording sheet without a blank, in order to adjust the contact of the pressure roller with the sheet feed roller at an arbitrary timing during recording in the printing unit, it is necessary to provide a CR motor for bringing the pressure roller into pressure contact with the sheet feed roller or separating the pressure roller from the sheet feed roller, as well as the UD motor for bringing the thermal head into pressure contact with the platen roller or separating (moving up) the thermal head from the platen roller and the LF motor for rotating the sheet feed roller forward or backward, which are provided in a general recording apparatus. If the UD motor also serves as the CR motor, it is necessary to increase the capacity of the UD motor since the UD motor does not have a sufficiently large capacity, which results in an increase in manufacturing costs.

These and other drawbacks exist.

SUMMARY OF THE DISCLOSURE

According to various embodiments, a recording apparatus may include: a printing unit that contacts or separates a thermal head with or from a platen using the driving force of a UD motor; one ore more sheet feed units that may include sheet feed rollers which are rotated forward or backward by the driving force of an LF motor transmitted through a transport gear group and pressure rollers which may be supported between a pair of roller supporting members and may be urged by elastic members to come into pressure contact with the sheet feed rollers, and may be provided on an upstream side and a downstream side of the printing unit in a transport path of a recording sheet; a pressure release mechanism including a cam shaft that may be rotatably provided so as to tilt the pair of roller supporting members of the sheet feed units against the urging force of the elastic members and may separate the pressure rollers from the sheet feed rollers; and a pressure release gear group that may transmit the driving force of the LF motor to the cam shaft of the pressure release mechanism, the driving force of the LF motor being transmitted to the pressure release gear group and the transport gear group. When the recording sheet is transported, the cam shaft of the pressure release mechanism may be rotated, and the sheet feed units that separate the pressure rollers from the sheet feed roller are selected, and the pair of roller supporting members of any one of the sheet feed units are tilted against the urging force of the elastic members to separate the pressure rollers from the sheet feed rollers.

Various embodiments may further include a tilt adjusting mechanism including: a UD cam that may be supported so as to be rotatable by the driving force of the UD motor and may have a tilting groove formed in a flat portion thereof; a connection lever that may include a cam follower engaged with the tilting groove of the UD cam formed at the leading end thereof and may be tiltably supported; and a tilting plate that may be connected to the other end of the connection lever and may be tiltably supported. The cam follower may be moved along the tilting groove to adjust the tilting of the tilting plate. The pressure release gear group may include: a shaft gear that may be provided in the vicinity of the end of the cam shaft and may convert a driving force transmitted from a gear group arranged on the upstream side into the rotating force of the cam shaft; a first tilt gear that may be provided on the tilting plate which may be tiltable about a tilting shaft, engaged with the shaft gear when transmitting the driving force of the LF motor as a rotating force in the forward direction, and may transmit the driving force transmitted from the gear group that is arranged on the upstream side to the shaft gear; a second tilt gear that may be provided on the tilting plate so as to be spaced from the first tilt gear, engaged with the shaft gear when transmitting the driving force of the LF motor as a rotating force in the backward direction, and may transmit the driving force transmitted from the gear group that is arranged on the upstream side to the shaft gear; and idle gears that may be engaged with the first tilt gear and the second tilt gear and transmit the driving force transmitted from the gear group that is arranged on the upstream side to the first tilt gear and the second tilt gear.

According to the recording apparatus of various embodiments of the invention, an LF motor having large capacity also may be used as a motor for driving a pressure release mechanism. According to this structure, it may be possible to decrease the number of motors and reduce manufacturing costs. In addition, it may be possible to simplify the structure of an apparatus and reduce the size of the apparatus.

DESCRIPTION OF EXEMPLARY EMBODIMENTS

The following description is intended to convey a thorough understanding of the embodiments described by providing a number of specific embodiments and details involving a recording apparatus. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

Hereinafter, a recording apparatus according to an embodiment of the invention will be described with reference to FIGS. 1 to 16.

Figure 1:
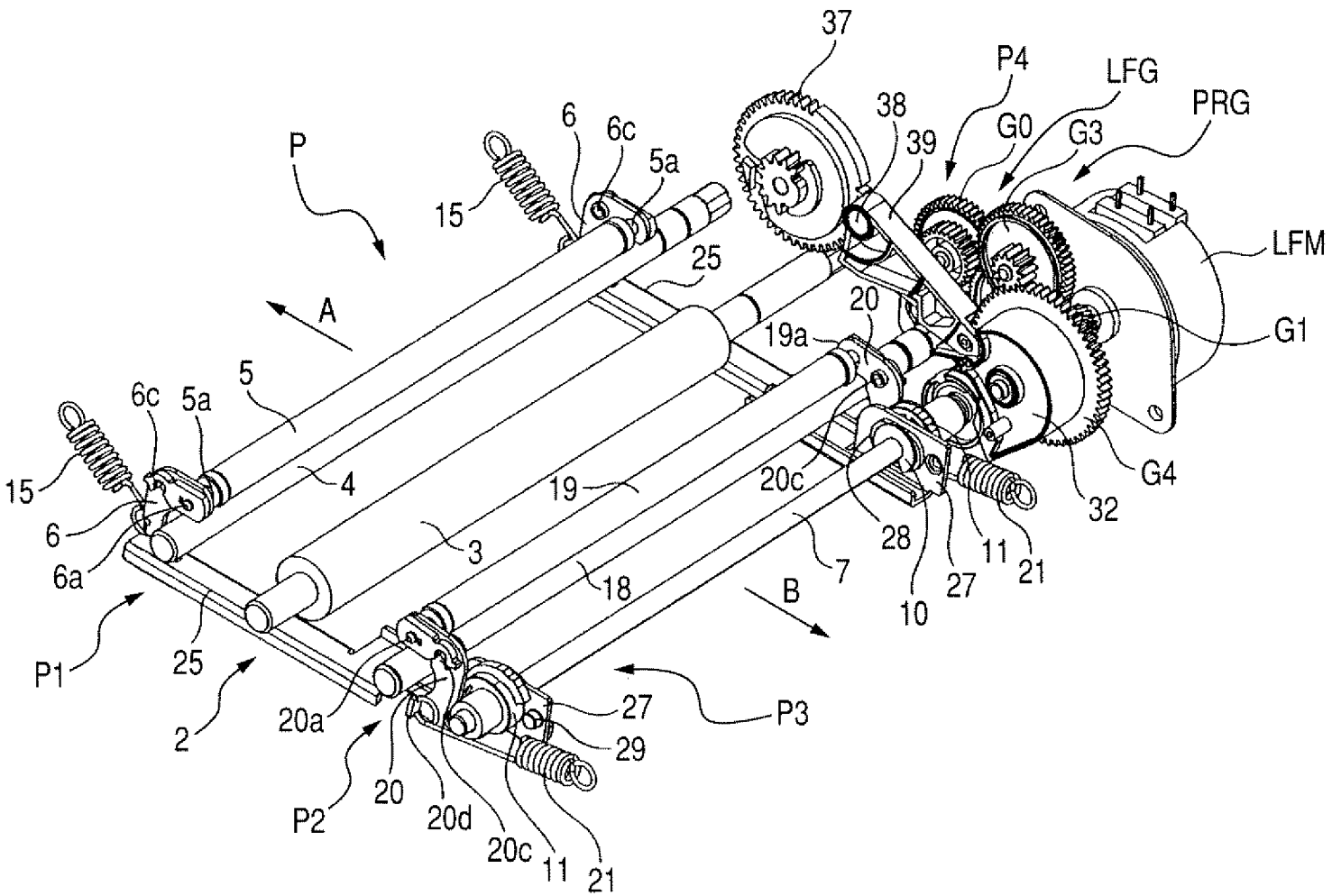
FIG. 1 is a perspective view illustrating An aspect of a recording apparatus according to an embodiment of the disclosure.

As shown in FIG. 1, a recording apparatus P according to an embodiment may include a printing unit 2 that can print a desired image on a recording sheet (not shown), such as a printing sheet, and may be provided in the middle of a transport path of the recording sheet which can be reciprocated in the directions of arrows A and B.

The printing unit 2 may include a cylindrical platen roller 3 that may be provided in a chassis (not shown) so as to be orthogonal to the transport direction of the recording sheet and can be rotated by driving force for transporting the recording sheet, which may be transmitted from an LF motor LFM, and a thermal head (not shown) that can come into contact with or be separated from the platen roller 3 by the driving force of a UD motor (not shown).

A first sheet feed unit P1 may be provided on a downstream side in the transport direction of the recording sheet that is represented by the arrow A, that is, on the left side of the platen roller 3, and a second sheet feed unit P2 may be provided on an upstream side in the transport direction of the recording sheet that is represented by the arrow B, that is, on the right side of the platen roller 3.

In the first sheet feed unit P1, a first sheet feed roller 4 that can be rotated forward or backward by the driving force for transporting the sheet transmitted from the LF motor LFM may be provided on the downstream side of the transport path of the recording sheet such that it may be orthogonal to the transport direction of the recording sheet and may be rotatable between the chassis (not shown). In addition, a first pressure roller 5 that can come into pressure contact with the first sheet feed roller 4 may be provided above the transport path of the recording sheet. Rotating shafts 5*a* provided at both ends of the first pressure roller 5 in the axial direction may be supported by a pair of first roller supporting members 6, which may be L-shaped bellcranks, such that the first pressure roller 5 can rotate.

Figure 2:
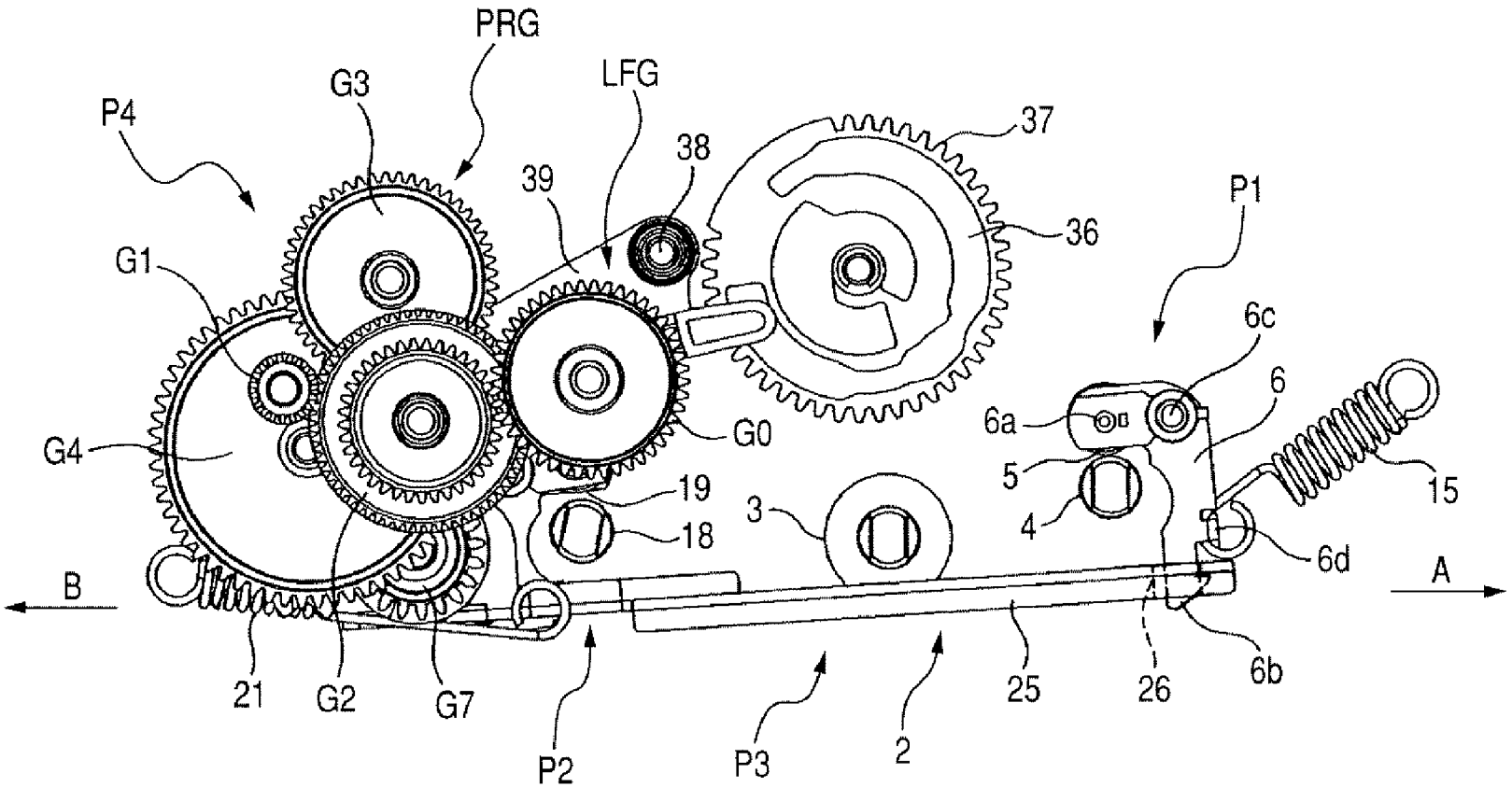
FIG. 2 is a perspective view illustrating portions of the structure of a tilt adjusting mechanism of the recording apparatus shown in FIG. 1.

As shown in FIG. 2, in the first roller supporting member 6, a bent portion having a bellcrank shape may have one end that extends downward in the vertical direction and the other end that extends toward the printing unit 2. In this way, the first roller supporting member 6 can be tilted about a first rotation supporting portion 6*c* provided in the bent portion in the chassis. A first roller supporting portion 6*a* that supports the rotating shaft 5*a* of the first pressure roller 5 may be formed at the leading end (hereinafter, referred to as an upper end) of a portion extending toward the printing unit 2, and a hook portion 6*b* that protrudes in a direction that is opposite to the direction in which the printing unit 2 is arranged is formed at the leading end (hereinafter, referred to as a lower end) of a portion extending downward. In addition, an engaging portion 6*d* may be provided at the lower end, and a first elastic member 15 composed of an extension coil spring may be engaged with the engaging portion 6*d* such that the lower end of the first roller supporting member 6 may be elastically urged in the direction of the arrow A all the time. Therefore, the first pressure roller 5 supported by the first roller supporting portion 6*a* of the first roller supporting member 6 can come into pressure contact with the first sheet feed roller 4 by the urging force of the first elastic member 15. In addition, the hook portion 6*b* may be engaged with an engaging hole 26 of a link member 25 of a pressure release mechanism P3, which will be described below, by the urging force of the first elastic member 15, thereby holding one end of the link member 25.

Similarly, in the second sheet feed unit P2, a second sheet feed roller 18 that can be rotated forward or backward by the driving force for transporting the sheet transmitted from the LF motor LFM may be provided on the downstream side of the transport path of the recording sheet, and a second pressure roller 19 may be provided above the second sheet feed roller with the transport path of the recording sheet interposed therebetween. Rotating shafts 19*a* provided at both ends of the second pressure roller 19 in the axial direction may be supported by a pair of second roller supporting members 20, which may be L-shaped bellcranks, such that the second pressure roller 19 can rotate.

Similarly to the first roller supporting member 6, the upper end of the second roller supporting member 20 may extend toward the printing unit 2, and the second roller supporting member 20 can be tilted about a second rotation supporting portion 20*c* provided in a bent portion in the chassis of the recording apparatus P. A second roller supporting portion 20*a* that may support the rotating shaft 19*a* of the second pressure roller 19 may be formed at the upper end, and an engaging portion 20*d* may be formed at the lower end. A second elastic member 21 composed of an extension coil spring may be engaged with the engaging portion 20*d* such that the lower end of the second roller supporting member 20 may be elastically urged in the direction of the arrow B all the time. Therefore, the second pressure roller 19 supported by the second roller supporting portion 20*a* of the second roller supporting member 20 can come into pressure contact with the second sheet feed roller 18 by the urging force of the second elastic member 21. In addition, second cam followers 30 that may be engaged with second control cams 13 of second cam members 11 of the pressure release mechanism P3, which will be described below, may be formed at the lower ends of the second roller supporting members 20 so as to be opposite to each other.

In a sheet feed mechanism 1 according to an embodiment of the disclosure, a cam shaft 7 of the pressure release mechanism P3 that separate the pressure rollers 5 and 19 from the sheet feed rollers 4 and 18 of the sheet feed units P1 and P2 may be provided on the upstream side of the second sheet feed unit P2 that may be provided on the upstream side in the transport direction of the recording sheet during recording.

That is, in the pressure release mechanism P3, the cam shaft 7 that is parallel to the axial direction of the second sheet feed roller 18 may be rotatably provided between the chassis (not shown), and a pressure release gear group PRG that may transmit the driving force of the LF motor LFM for rotating the cam shaft 7 at a predetermined angle may be mounted to a printer body 9.

Figure 3B:
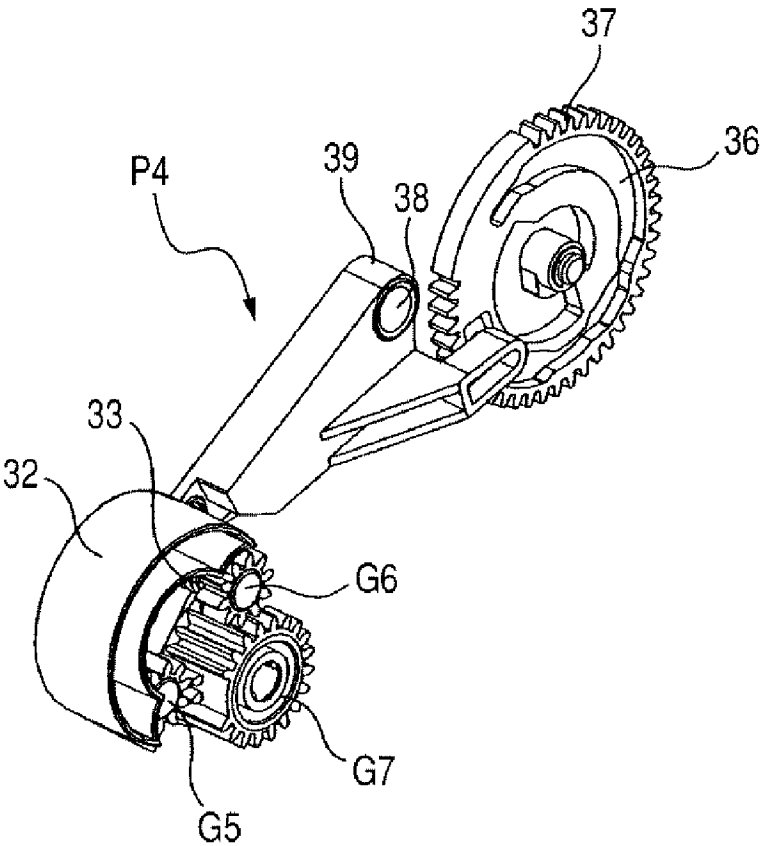
FIG. 3B is a diagram illustrating a connected state of a first tilt gear, a second tilt gear, and a shaft gear of the pressure release gear group in the tilt adjusting mechanism according to embodiments of the disclosure.
Figure 3A:
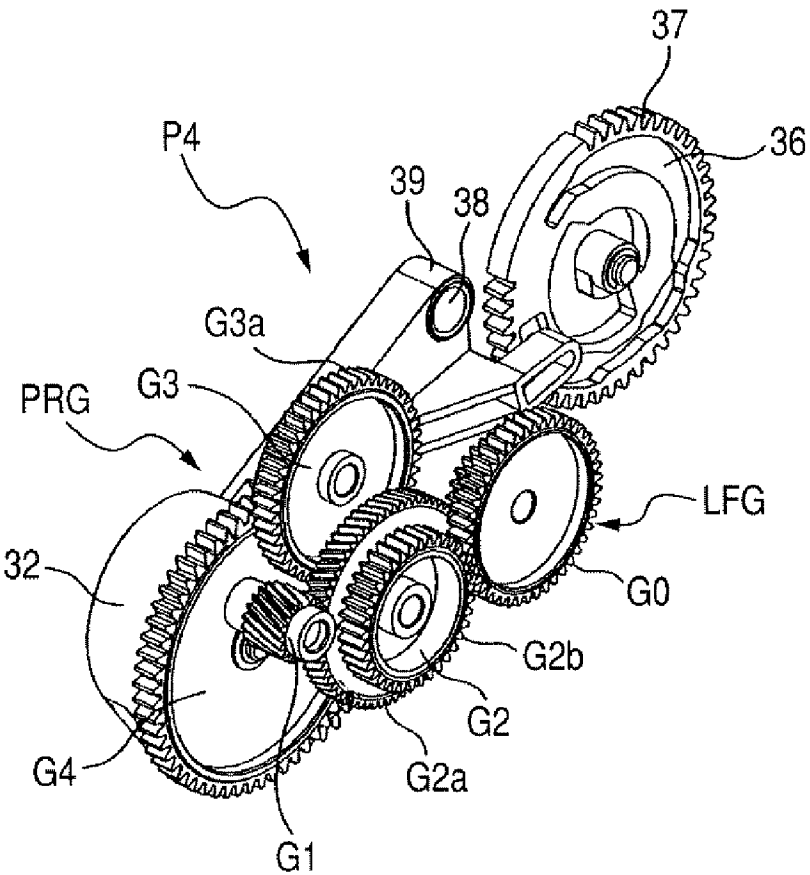
FIG. 3A is a diagram illustrating a connected state of an LF pinion gear to a second idle gear of a pressure release gear group in the tilt adjusting mechanism according to embodiments of the disclosure.
Figure 4:
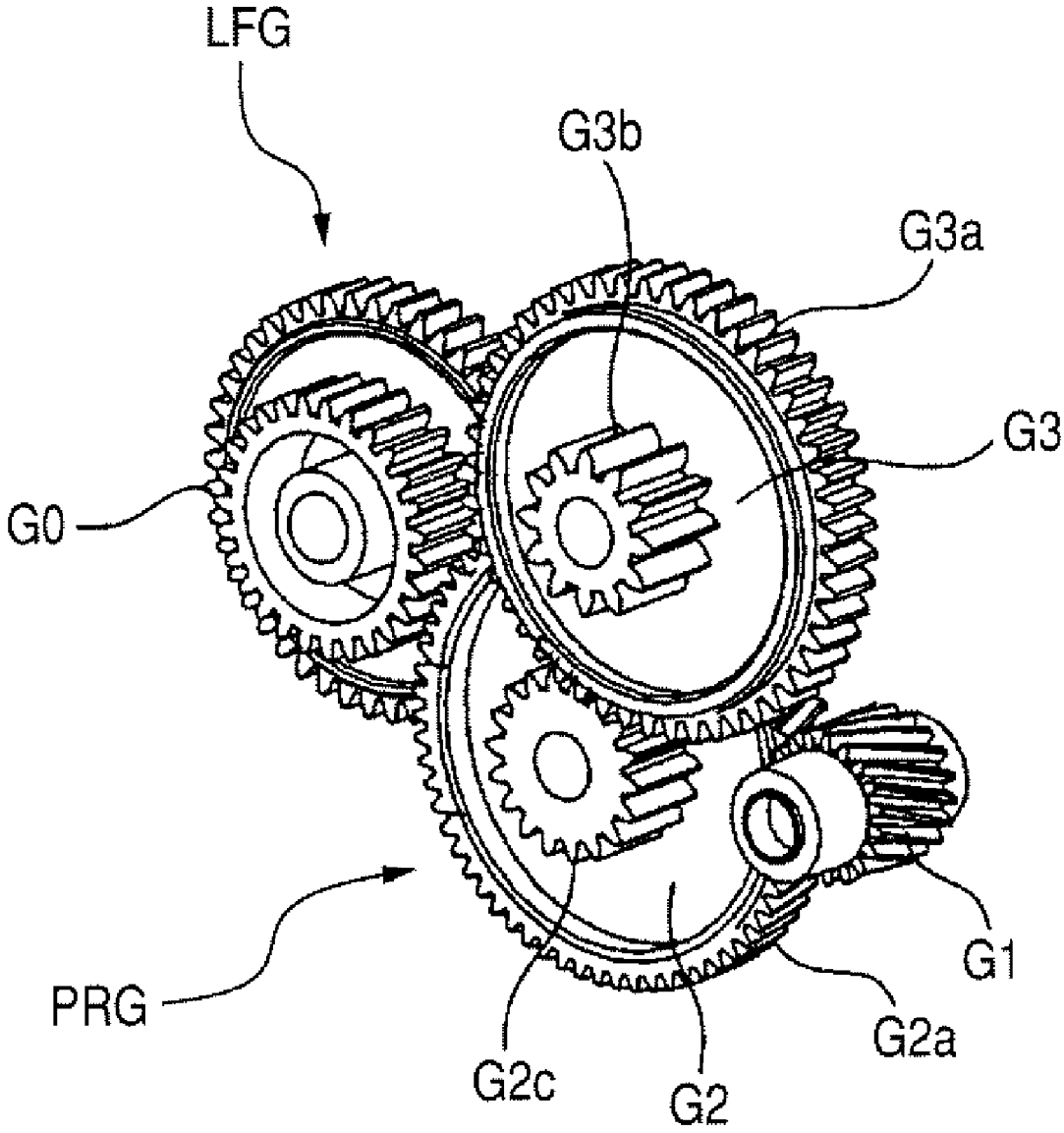
FIG. 4 is a diagram illustrating a connected state of the LF pinion gear to a first idle gear of the pressure release gear group in the tilt adjusting mechanism (as viewed in a direction reverse to the viewing direction of FIG. 3A) according to embodiments of the disclosure.

In this embodiment, as shown in FIGS. 2 to 4, for example, the pressure release gear group PRG may include an LF pinion gear G1 that may be fitted to a rotating shaft of the LF motor LFM, a shaft gear G7 that may be provided at the end of the cam shaft 7 and may convert the driving force transmitted a gear group arranged on the upstream side into the rotating force of the cam shaft 7, and a branch gear G2, a first idle gear G3, a second idle gear G4, a first tilt gear G5, and a second tilt gear G5 arranged between the LF pinion gear G1 and the shaft gear G7 in this order.

Figure 5A:
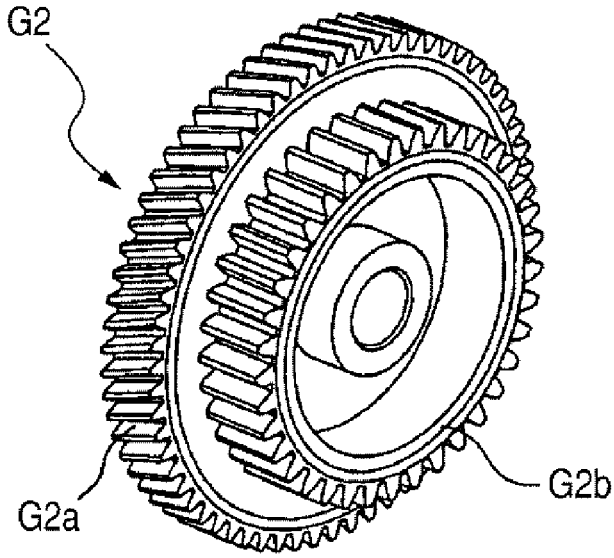
FIGS. 5A and 5B are perspective views illustrating the shape of a branch gear (triple gear) (the front and rear sides of the branch gear are shown in FIGS. 5A and 5E, respectively)
Figure 5B:
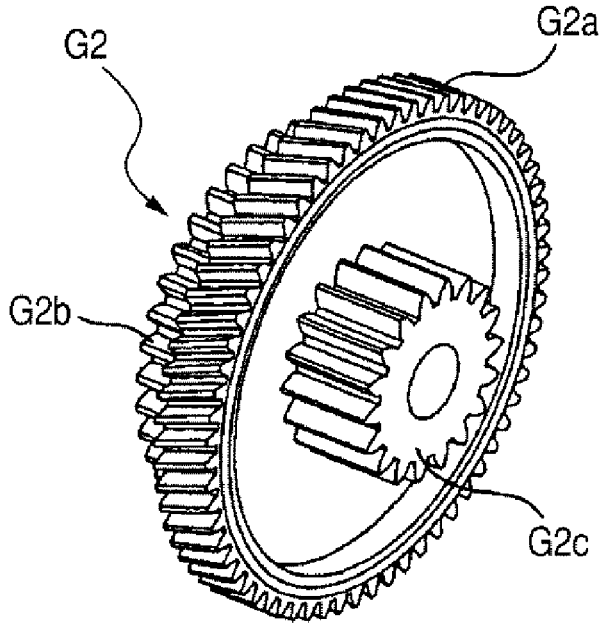

As shown in FIG. 5, a triple gear including three gears having a large diameter, a middle diameter, and a small diameter concentrically arranged may be used as the branch gear G2. The middle large-diameter gear G2*a* may be engaged with the LF pinion gear G0, and the middle-diameter gear G2*b* that is on the front side of FIG. 3A (the rear side in the depth direction in FIG. 4) may be engaged with a transport gear G0 of a transport gear group LFG. In addition, the small-diameter gear G2*c* that is on the rear side in the depth direction of FIG. 3A (the front side in the depth direction in FIG. 4) may be engaged with the first idle gear G3 of a pressure release gear group PRG arranged on the downstream side. In this way, it may be possible to transmit the driving force of the LF motor LFM using the transport gear group LFG and the pressure release gear group PRG.

A double gear including two gears having a large diameter and a small diameter concentrically arranged may be used as the first idle gear G3. A large-diameter gear G3*a* that is on the front side of FIG. 3A (the rear side in the depth direction in FIG. 4) may be engaged with the small-diameter gear G2*c* that is on the rear side in the depth direction of FIG. 3A (the rear side in the depth direction in FIG. 4) in the branch gear G2, and a small-diameter gear G3*b* that is on the rear side in the depth direction of FIG. 3A (the rear side in the depth direction in FIG. 4) may be engaged with the second idle gear G4 that is provided on the downstream side. In this way, it may be possible to transmit the driving force transmitted from a gear group provided on the upstream side to the second idle gear G4.

Figure 6A:
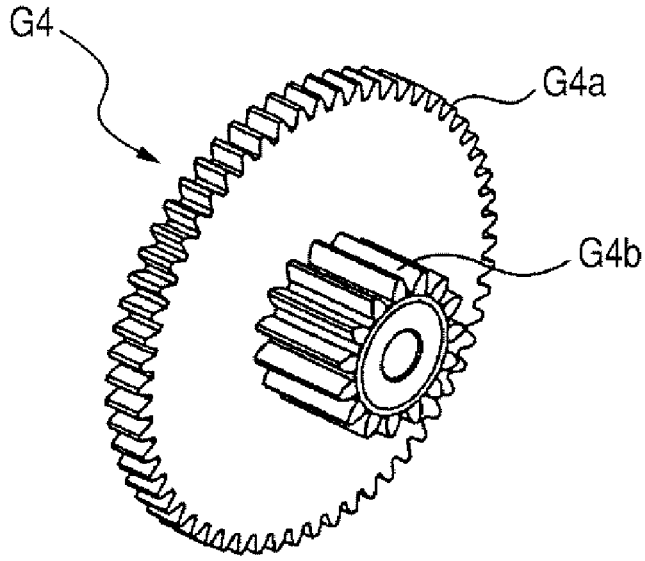
FIGS. 6A and 6B are perspective views illustrating the shape of the second idle gear (double gear) (the front and rear sides of the second idle gear are shown in FIGS. 6A and 6B, respectively)
Figure 6B:
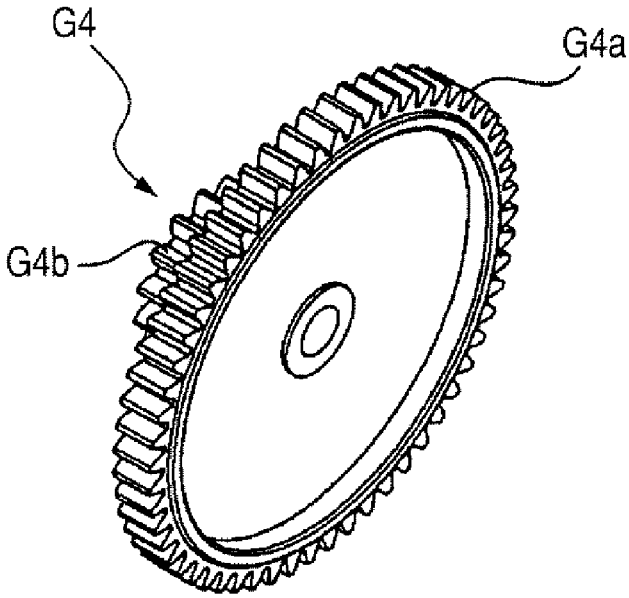

Similarly, as shown in FIG. 6, a double gear including two gears having a large diameter and a small diameter concentrically arranged may be used as the second idle gear G4. A large-diameter gear G4*a* that is on the front side of FIG. 3A may be engaged with the gear G3*b* that is on the rear side in the depth direction of FIG. 3A in the first idle gear G3, and a small-diameter gear G4*b* that is on the rear side in the depth direction of FIG. 3A may be engaged with the first tilt gear G5 and the second tilt gear G6 that are provided on the downstream side. In this way, it may be possible to transmit the driving force transmitted from the gear group provided on the upstream side to the first tilt gear G5 or the second tilt gear G6.

Figure 7:
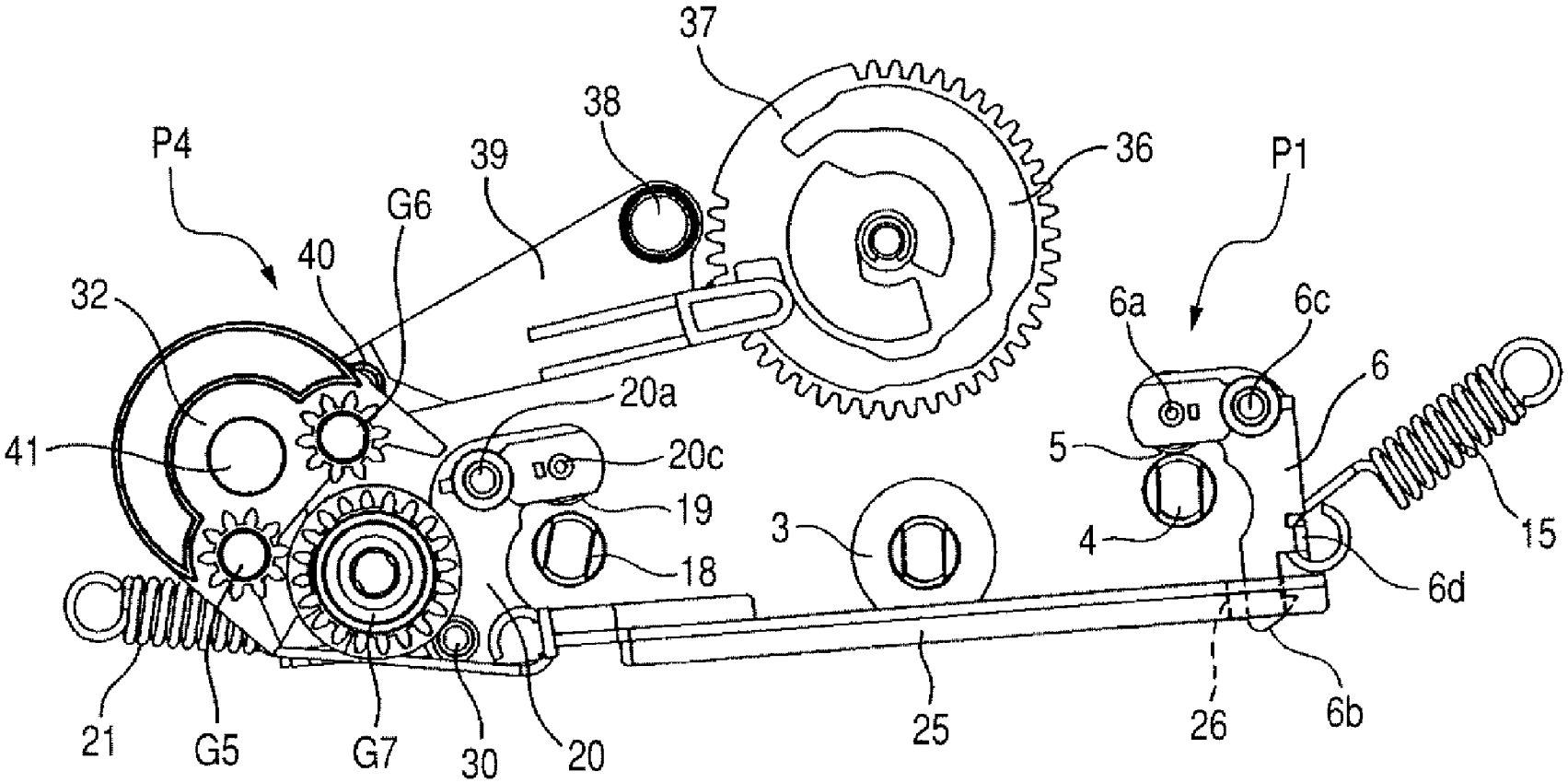
FIG. 7 is a diagram illustrating structure of a tilt adjusting mechanism according to embodiments of the disclosure, in which the LF pinion gear, the branch gear, and the first and second idle gears are omitted.

As shown in FIGS. 3B and 7, the first tilt gear G5 and the second tilt gear G6 may be provided on a tilting plate 32 of a tilt adjusting mechanism P4 such that they may be spaced from each other and disposed at different positions in the height direction (In FIG. 3B, the first tilt gear G5 may be lower than the second tilt gear G6). Coil springs 33 may be fitted to the rotating shafts of the tilt gears G5 and G6 between the tilting plate 32 and the surfaces facing the tilting plate 32 in a compressed state. When the second idle gear G4 is rotated, the rotating force of the second idle gear may be transmitted to the tilting plate 32 by pressure contact friction caused by the urging force of the coil springs 33, and the tilting plate 32 may be tilted in the same direction as that in which the second idle gear G4 may be rotated. Then, any one of the first tilt gear G5 and the second tilt gear G6 may be engaged with the shaft gear G7.

Figure 8:
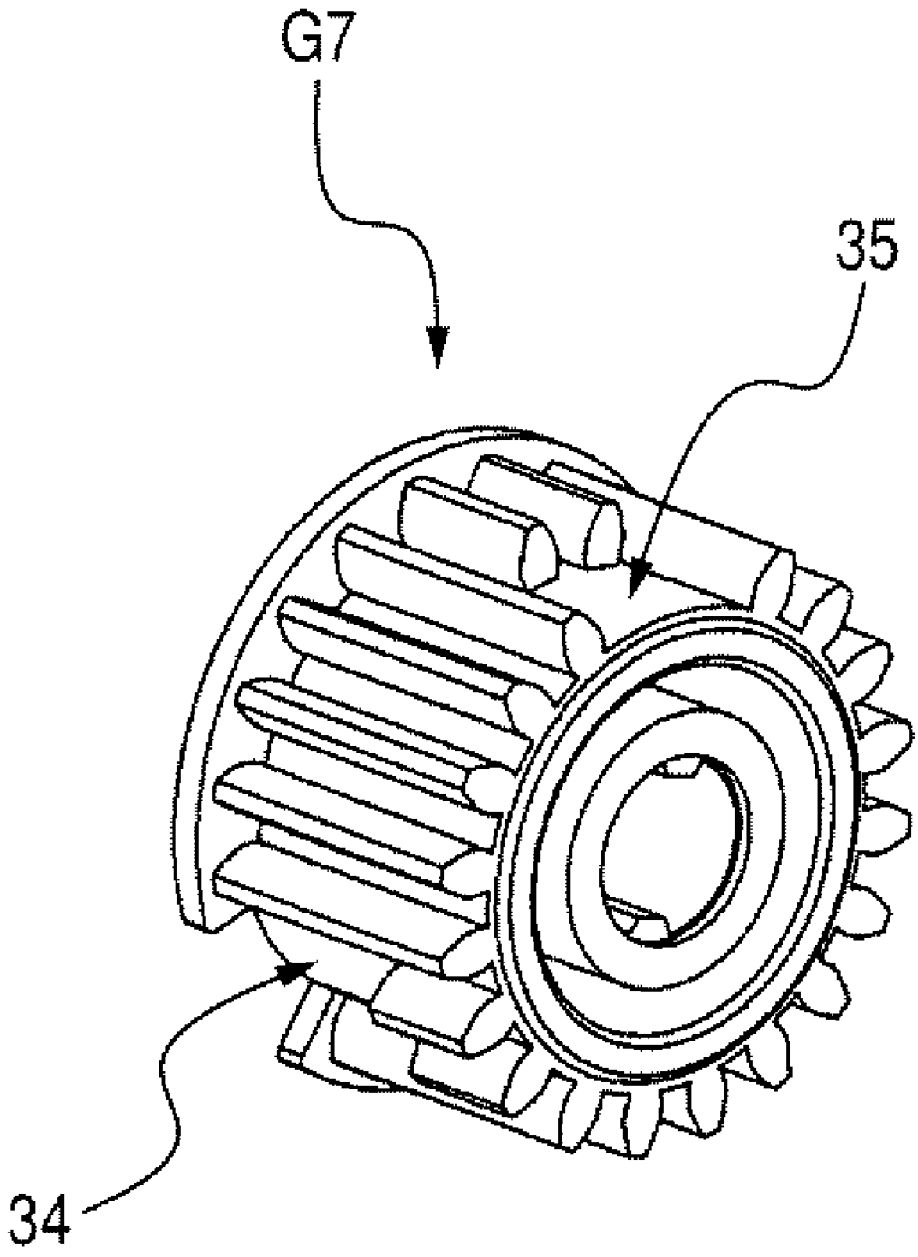
FIG. 8 is a perspective view illustrating the shape of a shaft gear according to embodiments of the disclosure.

As shown in FIG. 8, the shaft gear G7 that is engaged with the first tilt gear G5 and the second tilt gear G6 may include a base-side cutout portion 34 and a leading-end-side cutout portion 35. The base-side cutout portion may be formed by cutting out half of each of two adjacent gear teeth that is close to the base in the longitudinal direction, among gear teeth arranged in the circumferential direction of the shaft gear G7, and the leading-end-side cutout portion may be formed by cutting out half of each of two adjacent gear teeth that is close to the leading end in the longitudinal direction. The leading-end-side cutout portion 35 may be arranged at a predetermined angle with respect to the base-side cutout portion 34 (in this embodiment, for example, at an angle of about 120°).

When the driving force of the LF motor LFM is transmitted as rotating force in the forward direction during printing, the second idle gear G4 may be rotated and the tilting plate 32 may be tilted. Then, the first tilt gear G5 may be engaged with the base side of the shaft gear G7, and the driving force transmitted from a gear group arranged on the upstream side may be transmitted to the shaft gear G7. In addition, the first tilt gear G5 may be engaged with the base-side cutout portion 34 and may run idle, thereby performing only a sheet transport process. When the driving force of the LF motor LFM is transmitted as rotating force in the reverse direction, the second idle gear G4 may be rotated, and the tilting plate 32 may be tilted. Then, the second tilt gear G6 may be engaged with the leading end of the shaft gear G7, and the driving force transmitted from the gear group arranged on the upstream side may be transmitted to the shaft gear G7. In addition, the second tilt gear G6 may be engaged with the leading-end-side cutout portion 35 and runs idle, thereby performing only the sheet transport process.

The tilt adjusting mechanism P4 may be supported such that it can be rotated by the driving force of a UD motor (not shown), and may include a UD cam 37 that may have a tilting groove 36 formed in a flat portion, a connection lever 39 that may include a cam follower (not shown) engaged with the tilting groove 36 of the UD cam 37 formed at one end and may be supported so as to be tiltable about a tilting shaft 38, and the tilting plate 32 that is connected to the connection lever 39 by a pin (not shown) which may be movably fitted into a long hole 40 formed at the other end of the connection lever 39, and may be supported so as to be tiltable about a rotating shaft 41 which may be provided coaxially with the second idle gear 34. In this way, the cam follower may be moved along the tilting groove 36 to adjust the tilting of the tilting plate 32.

That is, the UD cam 37 may be supported so as to be rotatable in the forward or backward direction by the driving force of the UD motor transmitted through a gear engaged with the gear teeth formed on the outer circumferential surface, and the tilting groove 36 that can guide the position of the cam follower may be formed in the flat portion of the UD cam.

Figure 9A:
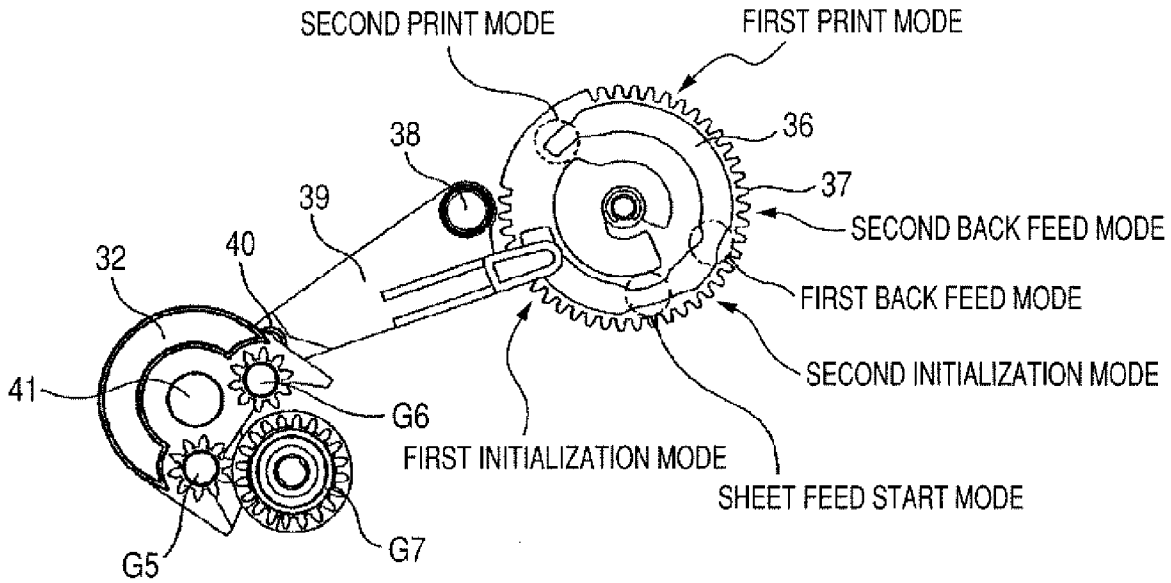
FIG. 9A is a diagram illustrating a tilt regulating region of a tilting groove formed in a UD cam according to embodiments of the disclosure.
Figure 9B:
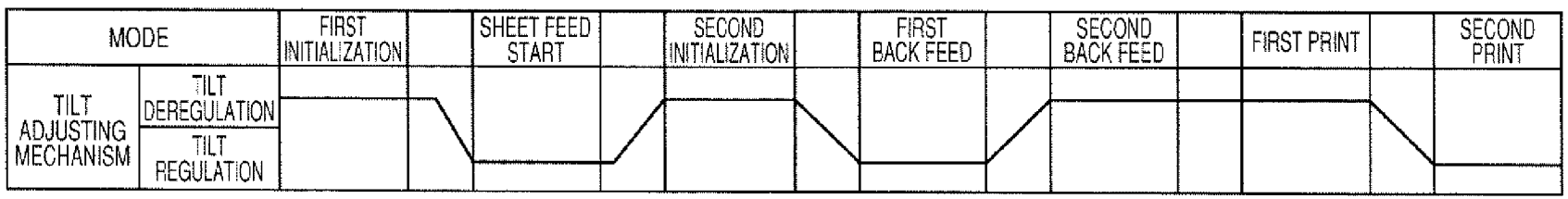
FIG. 9B is a table illustrating tilt adjustment modes of the UD cam according to embodiments of the disclosure.

FIG. 9A shows a wide tilt allowing region and a narrow tilt regulating region that may be formed in the tilting groove 36 of the UD cam 37. FIG. 9B is a table illustrating tilt adjustment modes of the UD cam 37. The tilting groove 36 has a path which may include, for example, seven modes, such as a first initialization mode, a sheet feed start mode, a second initialization mode, a first back-feed mode, a second back-feed mode, a first printing mode, and a second printing mode, from its one end in the clockwise direction in which the UD cam rotates, as shown in the tilt adjustment table.

Among the seven modes, in the sheet feed start mode, the first back-feed mode, and the second printing mode, for example, as represented by dotted circles in FIG. 9A, in order to regulate the tilting of the tilting plate 32, the tilting groove 36 may have a small width such that a tilting mechanism may be maintained at a neutral position without engaging the first tilt gear G5 and the second tilt gear G6 with the shaft gear G7.

In the first initialization mode and the second back-feed mode, for example, in order to allow the tilting of the tilting plate 32, the tilting groove 36 may have a large width, and the second tilt gear G6 may be engaged with the shaft gear G7. In the second initialization mode and the first printing mode, in order to allow the tilting of the tilting plate 32, the tilting groove 36 may have a large width, and the first tilt gear G5 may be engaged with the shaft gear G7. The second initialization mode may be used to bring the first pressure roller 5 into pressure contact with the first sheet feed roller 4, in order to prevent the release of the pressure contact between the first pressure roller 5 and the first sheet feed roller 4.

Figure 10:
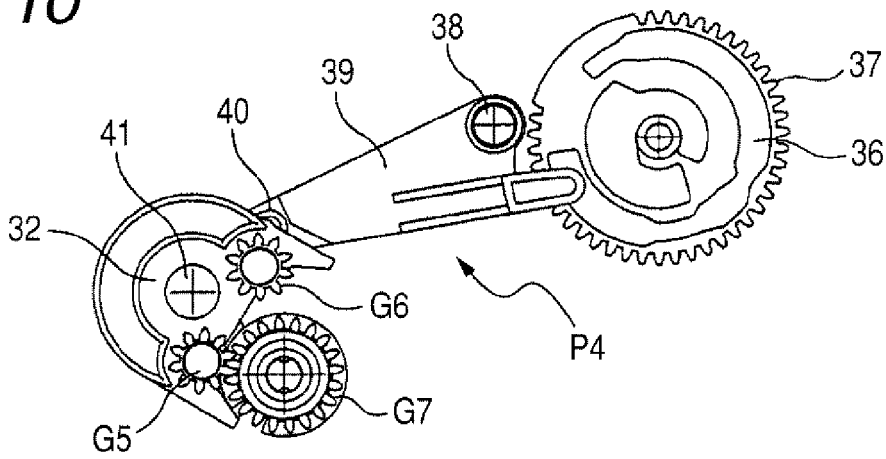
FIG. 10 is a diagram illustrating a tilted sate of a tilting plate according to embodiments of the disclosure (a first tilt gear is engaged with the shaft gear)
Figure 11:
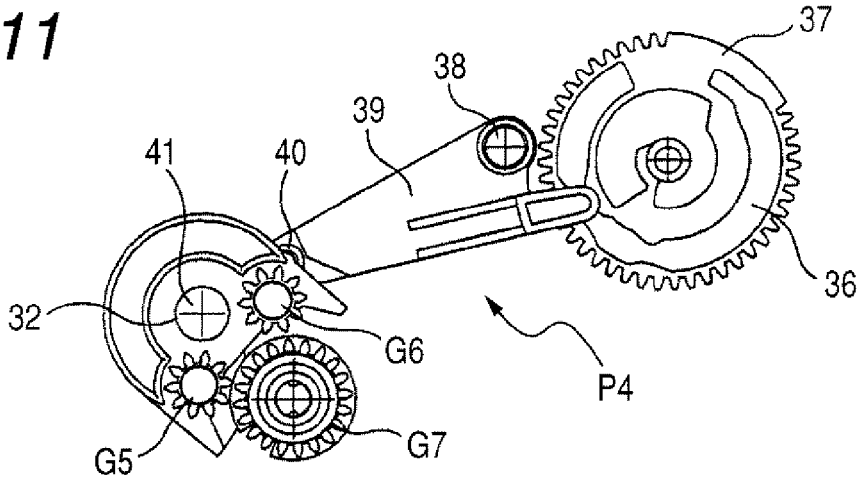
FIG. 11 is a diagram illustrating a tilt-regulated state of the tilting plate according to embodiments of the disclosure (neither the first tilt gear nor the second tilt gear is engaged with the shaft gear)
Figure 12:
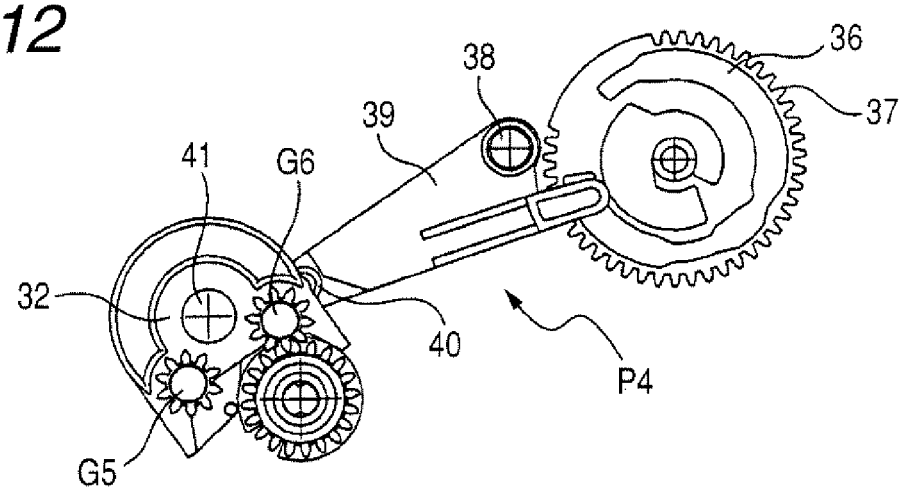
FIG. 12 is a diagram illustrating a tilted state of the tilting plate according to embodiments of the disclosure (the second tilt gear is engaged with the shaft gear)

FIGS. 10 to 12 are diagrams illustrating the regulation and deregulation of the tilting of the tilting plate 32. In a mode that may allow the tilting of the tilting plate 32 (in the first initialization mode in FIGS. 10 and 12), the tilting plate 32 may be tilted in a direction that may be aligned with the rotating direction of the second idle gear G4, and the first tilt gear G5 or the second tilt gear G6 may be engaged with the shaft gear G7. In this way, the driving force transmitted from the gear group arranged on the upstream side may be transmitted to the shaft gear G7 as rotating force in the forward or backward direction. In a mode that regulates the tilting of the tilting plate 32 (in the sheet feed mode in FIG. 11), as described above, the tilting of the tilting plate 32 may be regulated such that the tilting mechanism may be maintained at the neutral position without engaging the first tilt gear G5 and the second tilt gear G6 with the shaft gear G7, and the driving force transmitted from the gear group arranged on the upstream side is not transmitted to the shaft gear G7. That is, when the tilting of the tilting plate is regulated, the shaft gear G7 may not be rotated. Therefore, it may be difficult to tilt the first roller supporting member or the second roller supporting member to change the pressure contact between the pressure roller and the sheet feed roller.

During a printing operation, the cam follower may be controlled so as to reciprocate along the tilting groove 36 between the first back-feed mode position and the second printing mode position.

Referring back to FIG. 1, first cam members 10 may be rotatably supported in the vicinities of both ends of the cam shaft 7 in the axial direction, and second cam members 11 each having a laminated structure of two plate cams may be rotatably supported by the cam shaft 7 outside the first cam members 10.

Figure 13A:
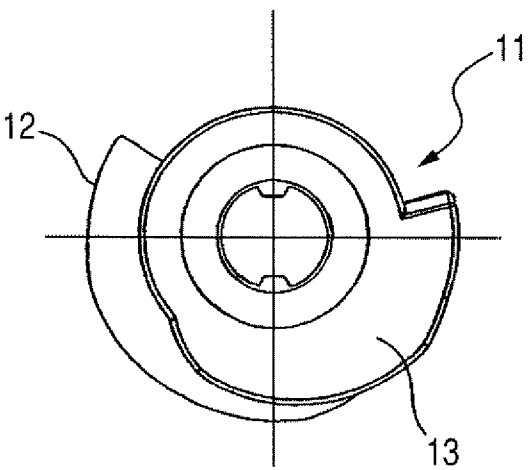
FIG. 13A is a plan view illustrating a second cam member of a pressure release member in a sheet feed mechanism shown in FIG. 1, as viewed from a second control cam.
Figure 13B:
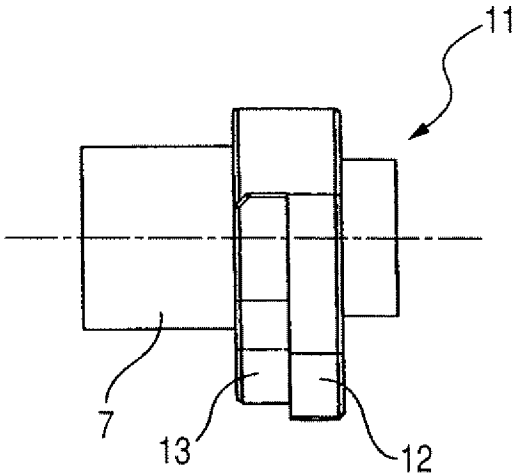
FIG. 13B is a cross-sectional view illustrating the second cam member illustrated in FIG. 13A.
Figure 13C:
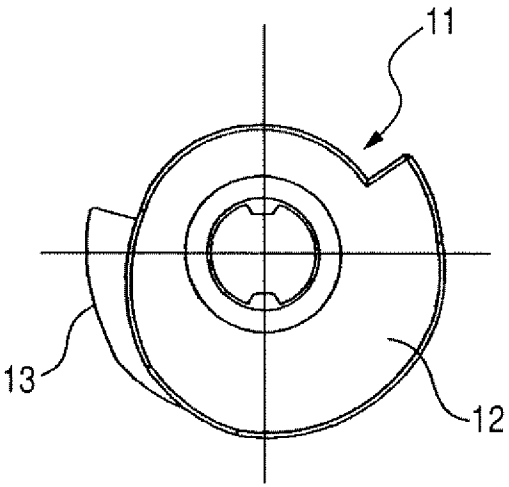
FIG. 13C is a plan view illustrating the second cam member illustrated in FIG. 13A, as viewed from a first control cam.

As shown in FIGS. 13A to 13C, the second cam member 11 may be formed by combining a first control cam 12 that can adjust the pressure contact of the first pressure roller 5 with the first sheet feed roller 4 in the first sheet feed unit P1 and the release of the pressure contact therebetween with a second control cam 13 that can adjust the pressure contact of the second pressure roller 19 with the second sheet feed roller 20 in the second sheet feed unit P2 and the release of the pressure contact therebetween, such that their outer circumferential portions having the largest diameter may be arranged at an angle of about 270° therebetween and a contact portion between a portion having the largest diameter and a circumferential portion having a small diameter may be changed when the control cams are rotated in the opposite direction. When the cam shaft 7 is rotated, the second cam member may be rotated approximately 270° such that the following three operation states may be set: a first state in which the first pressure roller 5 may come into pressure contact with the first sheet feed roller 4 in the first sheet feed unit P1, and the second pressure roller 19 may be separated from the second sheet feed roller 18 in the second sheet feed unit P2; a second state in which the pressure rollers 5 and 19 may come into pressure contact with the sheet feed rollers 4 and 18 in the first sheet feed unit P1 and the second sheet feed unit P2, respectively; and a third state in which the first pressure roller 5 may be separated from the first sheet feed roller 4 in the first sheet feed unit P1 and the second pressure roller 19 may come into pressure contact with the second sheet feed roller 18 in the second sheet feed unit P2.

The pressure release mechanism P3 may include a pair of long link members 25 that may extend in the direction in which the recording sheet is transported during recording. Engaging holes 26 may be formed at the ends of the link members 25 on the downstream side in the direction in which the recording sheet is transported. Each of the engaging holes 26 may be a space that may be engaged with the hook portion 6*b* of the first roller supporting member 6, support one end of the link member 25, and allow the tilting of the first roller supporting member 6. Link plates 27 that may extend in the lateral direction may be provided on the upper surfaces of the link members 25 on the upstream side in the direction in which the recording sheet is transported during recording, such that the surfaces of the link plates may be aligned with the direction in which the recording sheet is transported. Elliptical cam holes 28 having the major axis in the lateral direction may be formed at the centers of the link plates 27. Each of the first cam members 10 may be fitted into the cam hole 28 to hold the other end of the link member 25, and the link member 25 can slide in the longitudinal direction of the cam hole 28.

Figure 14:
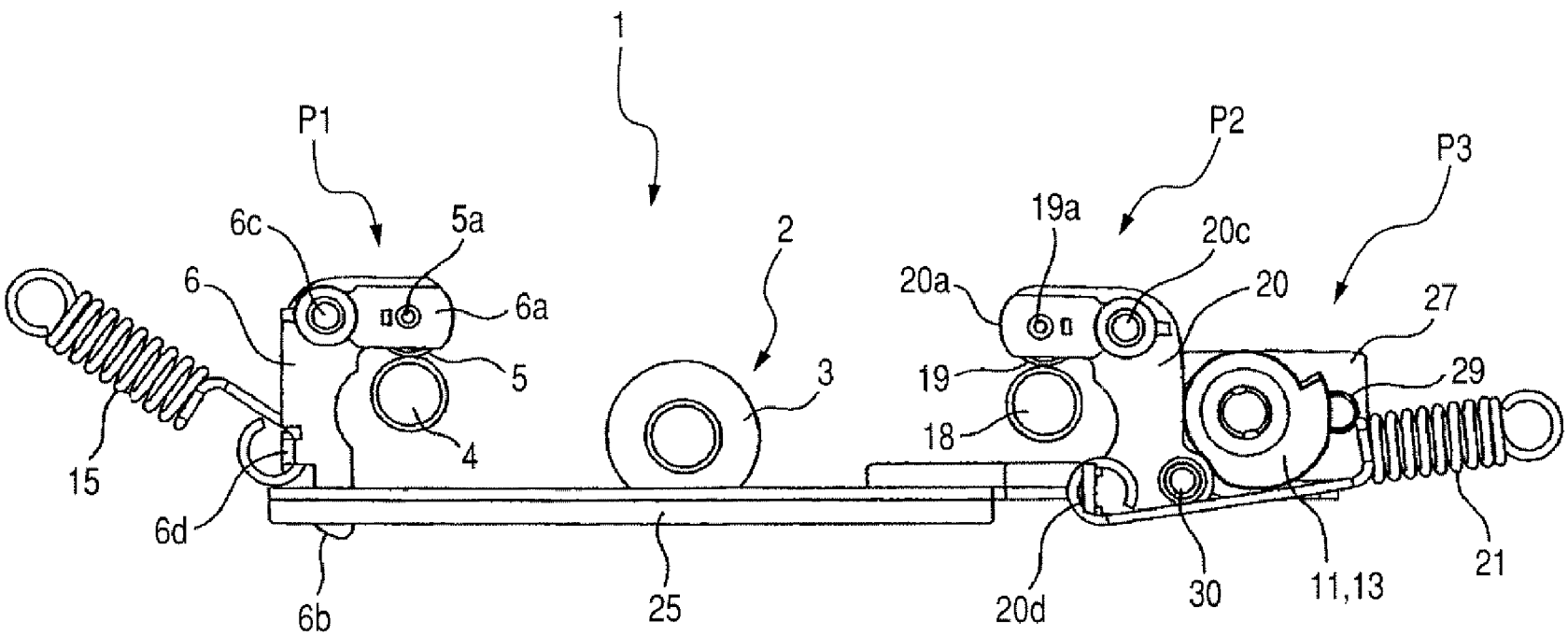
FIG. 14 is a front view illustrating a second state in which pressure rollers come into pressure contact with sheet feed rollers in both a first sheet feed unit and a second sheet feed unit according to embodiments of the invention.

A first cam follower 29 may be formed at one end of the outer surface of each of the link plates 27 on the downstream side in the direction in which the recording sheet is transported during recording, and may be engaged with the first control cam 12 of the second cam member 11. As shown in FIG. 14, the positional relationship between the first cam follower 29 and the second cam follower 30 with the second pressure roller 19 coming into pressure contact with the second sheet feed roller 20 may be adjusted such that the first control cam 12 of the second cam member 11 rotatably supported by the cam shaft 7 is not engaged with the first cam follower 29, the second control cam 13 is not engaged with the second cam follower 30, and the pressure rollers 5 and 19 may come into pressure contact with the sheet feed rollers 4 and 18 in the first sheet feed unit P1 and the second sheet feed unit P2, respectively (e.g., the second state).

Figure 15:
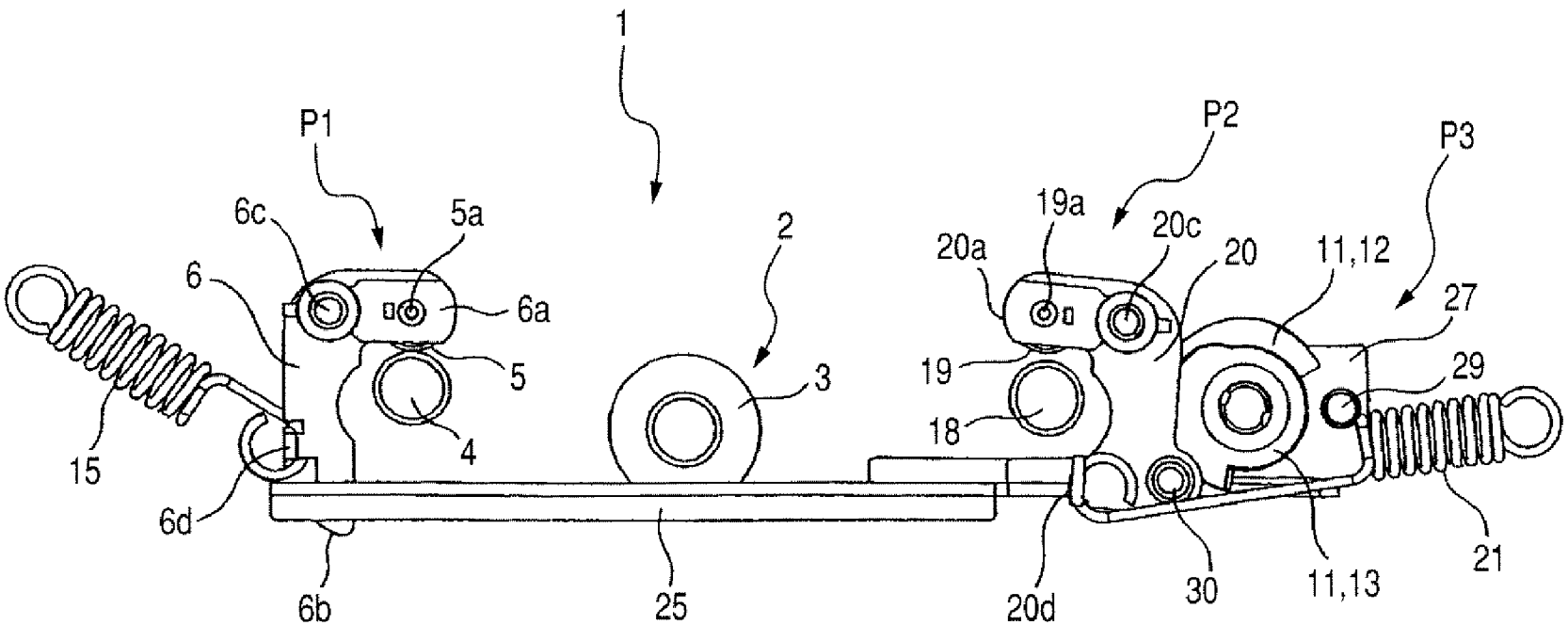
FIG. 15 is a front view illustrating a first state in which a first pressure roller comes into pressure contact with a first sheet feed roller in a first sheet feed unit and a second pressure roller is separated from a second sheet feed roller in a second sheet feed unit according to embodiments of the invention.

In various embodiments, when the LF motor LFM is driven, the rotating force thereof may be transmitted through the pressure release gear group PRG to rotate the cam shaft 7 by a predetermined angle in the clockwise direction. Then, as shown in FIG. 15, the circumferential surface of the second control cam 13 may be engaged with the second cam follower 30 to press the lower end of the second roller supporting member 20 to the printing unit with the cam circumferential surface having a large diameter, for example. Then, the second roller supporting member 20 may be rotated about the second rotation supporting portion 20*c* against the urging force of the second elastic member 21, and the second pressure roller 19 may be separated from the second sheet feed roller 18 by a predetermined distance in the second sheet feed unit P2. In this way, the second state can be changed to the first state. In this case, since the first control cam 12 is not engaged with the first cam follower 29, the first pressure roller 5 may come into pressure contact with the first sheet feed roller 4 in the first sheet feed unit P1 by the elastic force of the first elastic member 15 locked to the lower end of the first roller supporting member 6.

Figure 16:
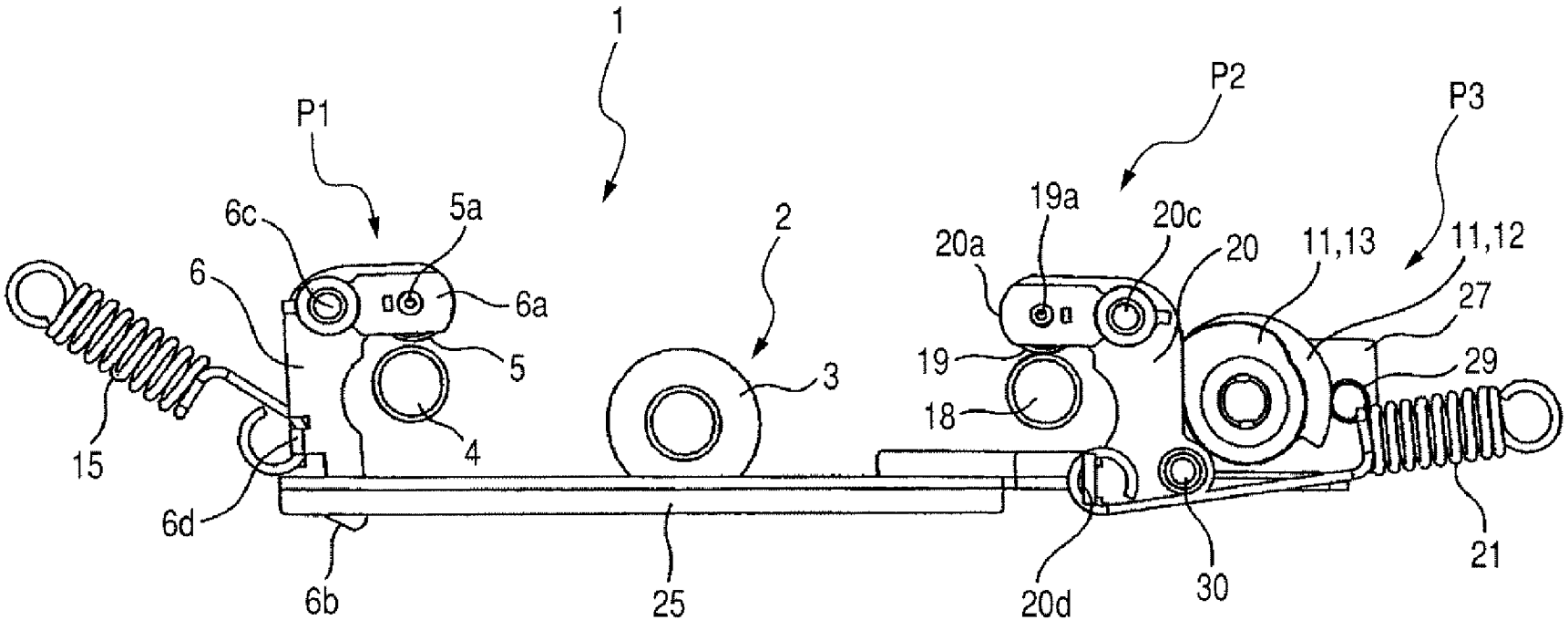
FIG. 16 is a front view illustrating a third state in which a first pressure roller is separated from a first sheet feed roller in a first sheet feed unit and a second pressure roller comes into pressure contact with a second sheet feed roller in a second sheet feed unit according to embodiments of the invention.

The second state can be changed to the third state as follows. When the LF motor LFM is driven, the rotating force thereof may be transmitted through the pressure release gear group PRG to rotate the cam shaft 7 by a predetermined angle in the clockwise direction. Then, as shown in FIG. 16, the circumferential surface of the first control cam 12 may be engaged with the first cam follower 29 to press the link plate 27 to the upstream side in the direction in which the recording sheet is transported during recording with the cam circumferential surface having a large diameter. Then, the link member 25 may be slid by the link plate 27 along the transport path of the recording sheet to the upstream side in the direction in which the recording sheet is transported during recording, and the lower end of the first roller supporting member 5 positioned in the engaging hole 26 formed at one end of the link member 25 may be drawn to the printing unit such that the first roller supporting member 5 may be rotated about the first rotation supporting portion 6*c* against the urging force of the first elastic member 15. Then, the first pressure roller 5 may be separated from the first sheet feed roller 4 by a predetermined distance. In this case, since the second control cam 13 is not engaged with the second cam follower 30, the second pressure roller 19 may come into pressure contact with the second sheet feed roller 18 in the second sheet feed unit P2 by the elastic force of the second elastic member 21 locked to the lower end of the second roller supporting member 20.

Next, the sheet transport operation of the recording apparatus P including the sheet feed mechanism 1 using the pressure release mechanism P3, for example, will be described.

In the recording apparatus P, a recording sheet may be fed from the front side where the first sheet feed unit P1 is provided. Then, the recording sheet may be transported to a predetermined position of the rear side (e.g., to the upstream side in the direction in which the recording sheet is transported) where the second sheet feed unit P2 is provided, and then may be cued. Then, the printing unit 2 may perform a desired recording process. Therefore, during a sheet feed process, the recording sheet may be fed with the rear end thereof facing forward. For example, during a color printing process, the above-mentioned operations may be repeated to correspond to the number of inks used. Finally, after a predetermined printing process is performed, the recording sheet may be discharged to the front side (e.g., to the downstream side in the direction in which the recording sheet is transported).

In the sheet feed mechanism 1, first, the UD cam 37 may be rotated by the driving force of the UD motor, and the cam follower of the connection lever 39 may be disposed at the first initialization mode position of the tilting groove 36 having a small width, thereby allowing the tilting of the tilting plate 32.

In this state, the LF motor LFM may be driven, and the driving force for rotating the first idle gear G3 backward may be transmitted through the pressure release gear group PRG. Then, the tilting plate 32 may be tilted to the rear side to engage the first tilt gear G5 with the base of the shaft gear G7. Then, the cam shaft 7 may be rotated a predetermined angle to be disposed at the first state, and the first pressure roller 5 may come into pressure contact with the first sheet feed roller 4 by the elastic force of the first elastic member 15 locked to the lower end of the first roller supporting member 6. Then, the transmitted recording sheet may be nipped by a sheet feed pinch roller (not shown).

The UD cam 37 may be rotated by the transmitted driving force of the UD motor to dispose the cam follower of the connection lever 39 at the sheet feed mode position of the tilting groove 36 having a small width. Then, the tilting of the tilting plate 32 may be regulated, and the first state may be maintained. During the sheet feed operation, the position of the recording sheet may be unstable. In this case, when the tilting plate 32 is tilted, the pressure rollers 5 and 19 may come into pressure contact with or may be depressed from the sheet feed rollers 4 and 18 in the first sheet feed unit P1 and the second sheet feed unit P2, respectively. As a result, a control timing error may occur.

Therefore, until a sheet sensor provided in the first sheet feed unit P1 correctly detects the position of a sheet, the tilting of the tilting plate 32 may be regulated at a neutral position where neither the first tilt gear G5 nor the second tilt gear G6 is not engaged with the shaft gear G7. In this way, the first state may be maintained.

During a normal operation, the first pressure roller 5 of the first sheet feed unit P1 may come into pressure contact with the first sheet feed roller 4. However, if the contact pressure is released due to a certain error, it may be necessary to bring the first pressure roller into pressure contact with the first sheet feed roller. In this case, the UD cam 37 may be rotated by the driving force of the UD motor to dispose the cam follower of the connection lever 39 at the second initialization mode position of the tilting groove 36 having a large width, thereby allowing the tilting of the tilting plate 32. The second initialization may be an irregular process. In the first state in which the first pressure roller 5 of the first sheet feed unit P1 comes into pressure contact with the first sheet feed roller 4, the LF motor LFM may be driven to discharge the recording sheet.

During the normal operation that does not require the irregular process, the UD cam 37 may be rotated by the driving force of the UD motor to dispose the cam follower of the connection lever 39 at the first back-feed mode position of the tilting groove 36 having a small width, thereby regulating the tilting of the tilting plate 32. Then, the first sheet feed roller 6 may be rotated by the driving force of the LF motor LFM transmitted through the transport gear group LFG to transport the recording sheet to the upstream side in the direction in which the recording sheet is transported during recording (hereinafter, this direction is simply referred to as an 'upstream side', and the opposite direction thereof is simply referred to as a 'downstream side').

When the sheet sensor (not shown) detects that the rear end of the recording sheet is inserted between the second sheet feed roller 18 and the second pressure roller 19 of the second sheet feed unit P2, the UD cam 37 may be rotated by the driving force of the UD motor to dispose the cam follower of the connection lever at the second back-feed mode position of the tilting groove 36 having a large width, thereby allowing the tilting of the tilting plate 32. Then, the LF motor LFM may be driven to rotate the second idle gear G4 to the front side, and the driving force thereof may be transmitted through the pressure release gear group PRG. In this way, the tilting plate 32 may be tilted to the front side, and the second tilt gear G6 may be engaged with the base side of the shaft gear G7. Then, the LF motor LFM may be driven to rotate the cam shaft 7 by a predetermined angle such that the second state is set. The leading end of the recording sheet may be pinched by the first sheet feed unit P1, and the rear end thereof is pinched by the second sheet feed unit P2. In this state, the sheet feed rollers 4 and 18 of the sheet feed units P1 and P2 may be rotated to transport the recording sheet to the upstream side.

Before the leading end of the recording sheet is out of the pinch point between the first sheet feed roller 4 and the first pressure roller 5 of the first sheet feed unit P1 (this timing can be managed by the number of driving steps of the first sheet feed roller 4), the LF motor LFM may be driven to rotate the cam shaft 7 by a predetermined angle to change the second state to the third state. Then, the first sheet feed roller 4 may be separated from the first pressure roller 5 in the first sheet feed unit P1, and the recording sheet may be further transported to the upstream side by only the rotating force of the second sheet feed roller 18 of the second sheet feed unit P2.

After the leading end of the recording sheet is transported to the upstream side of the recording position of the printing unit 2, the thermal head of the printing unit 2 may be moved down to be pressed against the platen roller 3 with the recording sheet interposed therebetween, thereby recording a desired image on the basis of recording information.

At the beginning of the recording operation, the recording sheet may be transported by the rotating force of the platen roller 3 and the rotating force of the second sheet feed roller 8 in the second sheet feed unit P2.

That is, the UD cam 37 may be rotated by the driving force of the UD motor to dispose the cam follower of the connection lever at the second printing mode position of the tilting groove 36 having a small width, thereby regulating the tilting of the tilting plate 32. Then, in the third state, the recording sheet may be transported by the rotating force of the second sheet feed roller 18 in the second sheet feed unit P2.

When the sheet sensor provided in the first sheet feed unit P1 detects that the rear end of the recording sheet is disposed on the downstream side of the first sheet feed unit, the UD cam 37 may be rotated in the counterclockwise direction by the driving force of the UD motor to dispose the cam follower of the connection lever at the first printing mode position of the tilting groove 36 having a large width, thereby allowing the tilting of the tilting plate 32. Then, the LF motor LFM may be driven, and the driving force for rotating the second idle gear G4 to the rear side may be transmitted through the pressure release gear group PRG. In this way, the tilting plate 32 may be tilted to engage the first tilt gear G5 with the base side of the shaft gear G7, and the cam shaft 7 may be rotated a predetermined angle, thereby setting the second state. Then, the leading end of the recording sheet may be pinched by the first sheet feed unit P1, and the rear end thereof may be pinched by the second sheet feed unit P2. In this state, the sheet feed rollers 4 and 18 of the sheet feed units P1 and P2 may be rotated to further transport the recording sheet to the downstream side.

Before the rear end of the recording sheet is out of the pinch point between the second sheet feed roller 18 and the second pressure roller 19 of the second sheet feed unit P2 (this timing can be managed by the number of driving steps of the second sheet feed roller), the LF motor LFM may be driven to rotate the cam shaft 7 by a predetermined angle, thereby setting the first state. Then, the second sheet feed roller 18 may be separated from the second pressure roller 19 in the second sheet feed unit P2, and the first sheet feed roller 4 may come into pressure contact with the first pressure roller in the first sheet feed unit P1. The recording sheet may be further transported to the downstream side by the rotating force of the first sheet feed roller and the driving force of the platen roller 3.

After recording on the rear end of the recording sheet is completed, the thermal head may be moved up to be separated from the platen roller 3. In this state, the recording sheet may be further transported to the downstream side by the rotating force of the first sheet feed roller 4 of the first sheet feed unit P1.

The back-feed operation and the transport operation in the printing direction may be repeatedly performed to print other color images on the previously formed image. In this way, it may be possible to print a desired color image on the recording sheet.

As described above, according to the recording apparatus P of various embodiments, the LF motor LFM also may be used as a motor for driving the pressure release mechanism P3. Accordingly, it may be possible to reduce the number of motors used and manufacturing costs. In addition, it may be possible to simplify the structure of an apparatus and reduce the size of the apparatus.

Also, the first and second elastic members 15 and 21, which may be extension coil springs, may be used to bring the first and second pressure rollers 5 and 19 into pressure contact with the first and second sheet feed rollers 4 and 15, respectively. However, the first and second elastic members 15 and 21 may be compression coil springs.

Accordingly, the embodiments of the present inventions are not to be limited in scope by the specific embodiments described herein. Further, although some of the embodiments of the present invention have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A recording apparatus comprising:

a printing unit that contacts or separates a thermal head with or from a platen using the driving force of an Up/Down (UD) motor;

one or more sheet feed units that include sheet feed rollers which are rotated forward or backward by the driving force of an Line Feed (LF) motor transmitted through a transport gear group and pressure rollers which are supported between a pair of roller supporting members and are urged by elastic members to come into pressure contact with the sheet feed rollers, and are provided on an upstream side and a downstream side of the printing unit in a transport path of a recording sheet;

a pressure release mechanism including a cam shaft that is rotatably provided so as to tilt the pair of roller supporting members of the one or more sheet feed units against the urging force of the elastic members and separates the pressure rollers from the sheet feed rollers;

a pressure release gear group that transmits the driving force of the Line Feed (LF) motor to the cam shaft of the pressure release mechanism, the driving force of the Line Feed (LF) motor being transmitted through the pressure release gear group and the transport gear group, the pressure release gear group including:

a shaft gear that is provided in the vicinity of the end of the cam shaft and converts a driving force transmitted from a gear group arranged on the upstream side into the rotating force of the cam shaft, a first tilt gear that is provided on a tilting plate which is tiltable about a tilting shaft, is engaged with the shaft gear when transmitting the driving force of the Line Feed (LF) motor as a rotating force in the forward direction, and transmits the driving force transmitted from the gear group that is arranged on the upstream side to the shaft gear, a second tilt gear that is provided on the tilting plate so as to be spaced from the first tilt gear, is engaged with the shaft gear when transmitting the driving force of the Line Feed (LF) motor as a rotating force in the backward direction, and transmits the driving force transmitted from the gear group that is arranged on the upstream side to the shaft gear, and one or more idle gears that are engaged with the first tilt gear and the second tilt gear and transmit the driving force transmitted from the gear group that is arranged on the upstream side to the first tilt gear and the second tilt gear; and a tilt adjusting mechanism including:

an Up/Down (UD) cam that is supported so as to be rotatable by the driving force of the Up/Down (UD) motor and has a tilting groove formed in a flat portion thereof, a connection lever that has a cam follower engaged with the tilting groove of the Up/Down (UD) cam formed at the leading end thereof and is tiltably supported, and a tilting plate that is connected to the other end of the connection lever and is tiltably supported, wherein, when the recording sheet is transported, the cam shaft of the pressure release mechanism is rotated, and at least one of the one or more sheet feed units that separate the pressure rollers from the sheet feed roller is selected, and the pair of roller supporting members of any one of the one or more sheet feed units are tilted against the urging force of the elastic members to separate the pressure rollers from the one or more sheet feed rollers, and the cam follower is moved along the tilting groove to adjust the tilting of the tilting plate.

* * * * *